United States Patent [19]

Reyner

[11] 4,360,131

[45] Nov. 23, 1982

[54] PRESSURE GENERATING APPARATUS

[75] Inventor: Ellis M. Reyner, New Brunswick, N.J.

[73] Assignee: Enviro-Spray Systems, Inc., Montgomeryville, Pa.

[21] Appl. No.: 223,422

[22] Filed: Jan. 8, 1981

Related U.S. Application Data

[63] Continuation of Ser. No. 105,216, Dec. 19, 1979, abandoned.

[51] Int. Cl.[3] ..... B65D 83/14

[52] U.S. Cl. ..... 222/386.5; 222/399

[58] Field of Search ..... 222/394, 386.4, 94, 222/190, 399, 55, 61, 52

[56] References Cited

U.S. PATENT DOCUMENTS 3,718,236 2/1973 Reyner et al. ..... 222/386.5

*Primary Examiner*—Stanley H. Tollberg

*Attorney, Agent, or Firm*—Kenyon & Kenyon

[57] ABSTRACT

A flexible enclosed plastic bag disposable in a product container for supplying dispensing pressure therein. The bag contains an envelope having its outer sides permanently attached to the respective inside walls of the bag. One of the sides of the envelope has one of a two component gas generating system disposed in a plurality of aligned pocket members formed therein with their openings facing the other side of the envelope, the latter being releasably adhered to the first mentioned side to enclose one component in the pockets. The bag contains the second component and a starting means to initially generate gas and expand the bag and develop product dispensing pressure within the container. As the product is dispensed, expansion of the bag causes sequential separation of the sides of the envelope and serial opening of the pockets to add aliquots of the first component to the second component and further generate gas and maintain pressure in the container until substantially all of the product is dispensed from the container.

25 Claims, 17 Drawing Figures

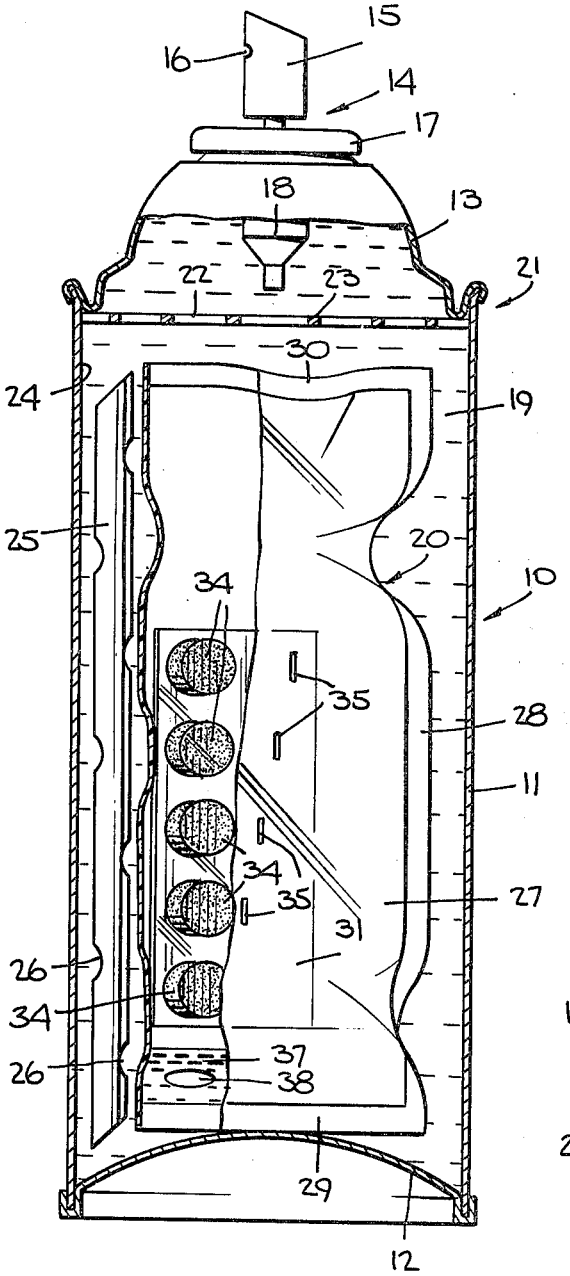
Fig. 1.
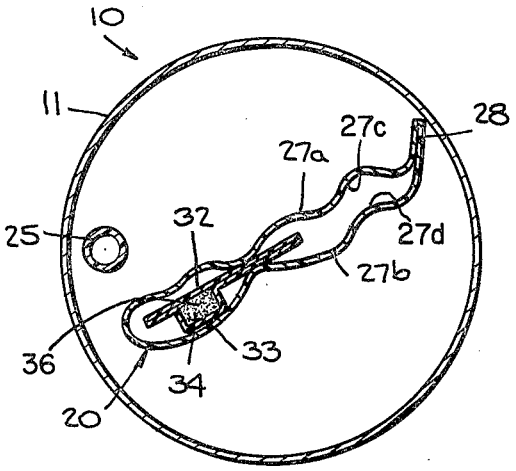
Fig. 2.
Fig. 3.
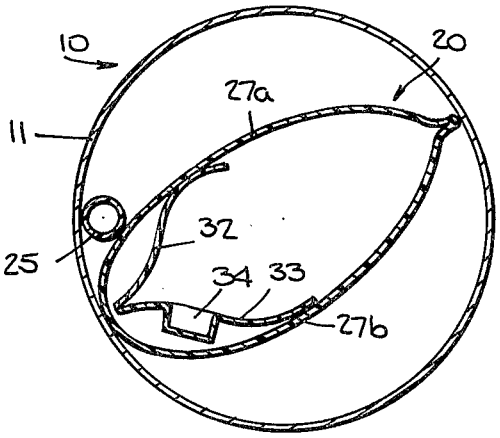

Fig. 8.
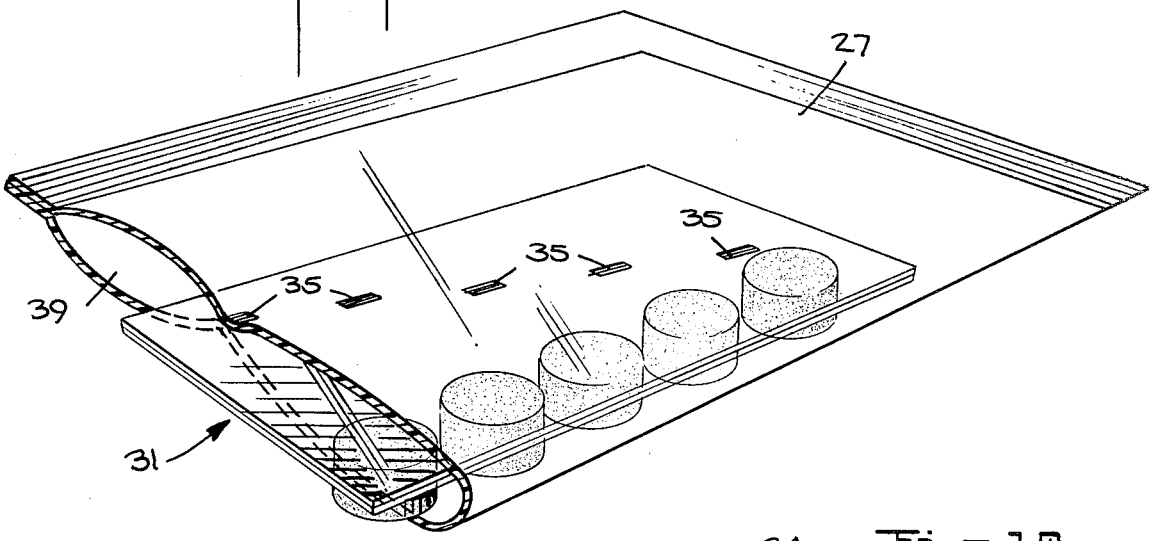
Fig. 13.
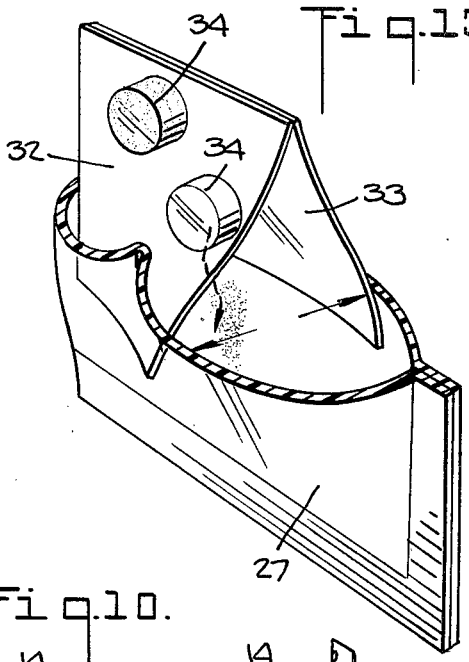
Fig. 12.
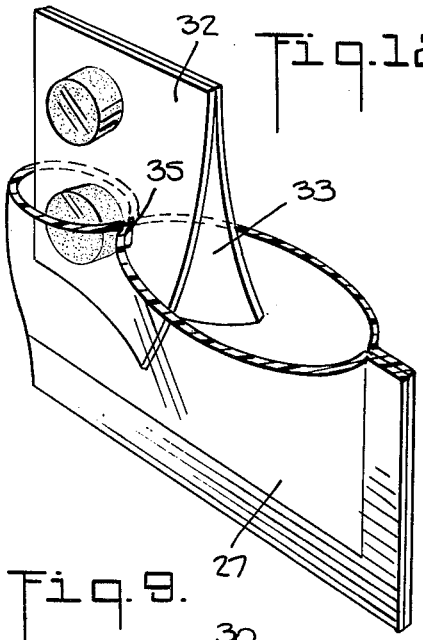
Fig. 9.
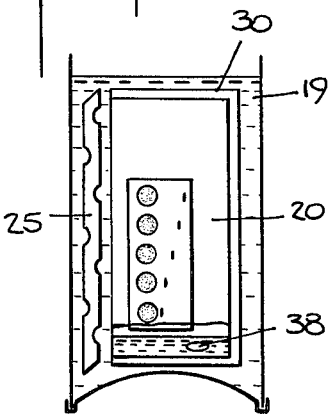
Fig. 10.
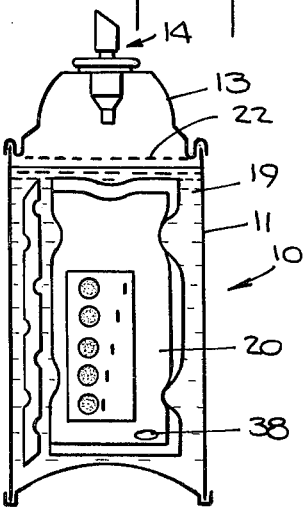
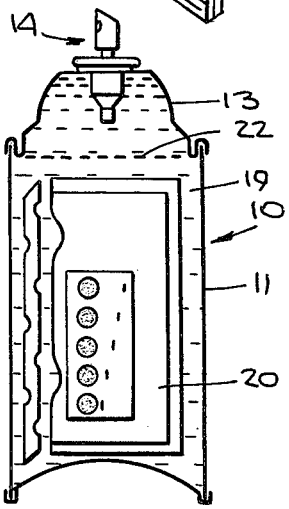
Fig. 11.

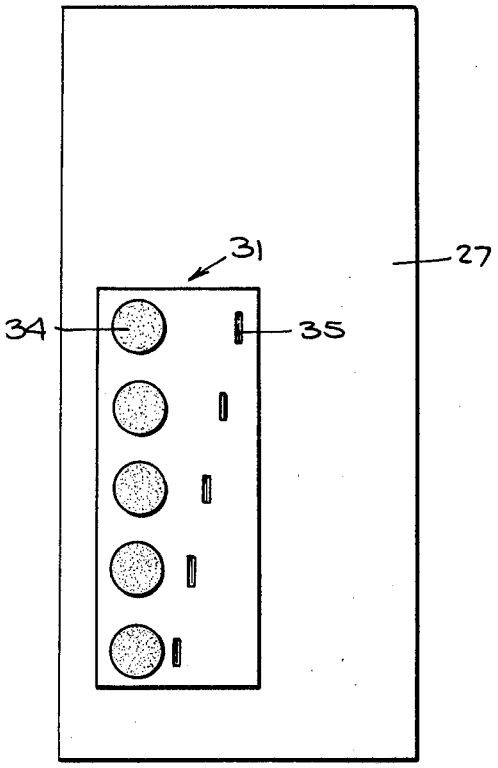
Fig.14.
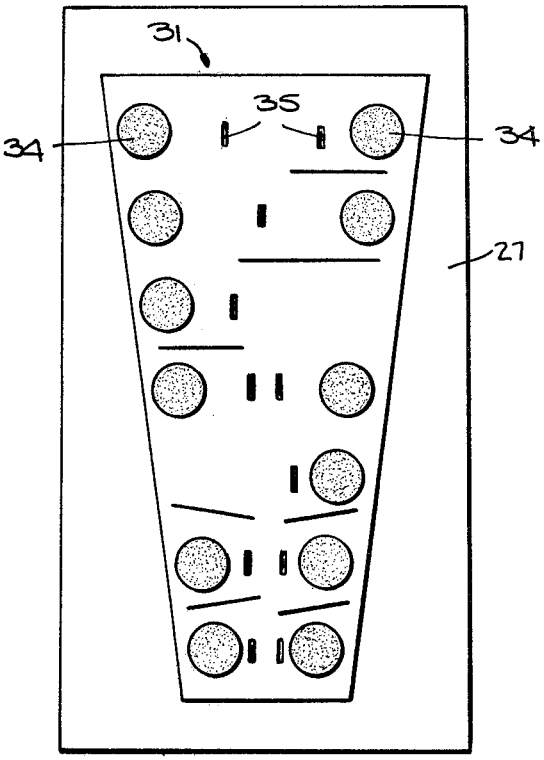
Fig.16.
Fig.15.
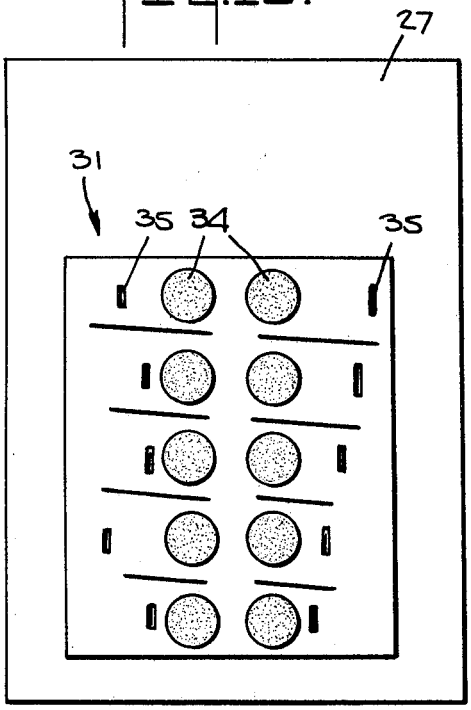
Fig.17.
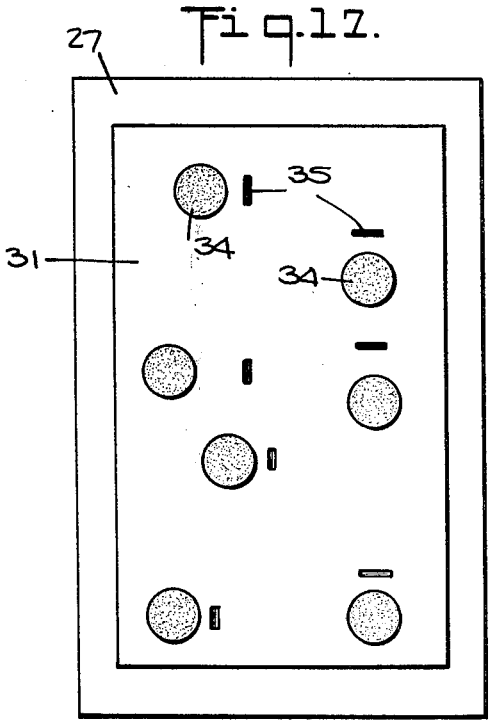

PRESSURE GENERATING APPARATUS

This is a continuation of application Ser. No. 105,216 filed Dec. 19, 1979 abandoned.

BACKGROUND OF THE INVENTION

For a long time there has been a need for a pressure generating system for use in product dispensing containers that is isolated from, and is not dispensed with, the product. This need has been partially due to environmental considerations but also for safety precautions, avoidance of product contamination or dilution as well as skin toxicity and/or irritation.

Furthermore, prior aerosol type dispensers generally were operable only in an upright condition, otherwise premature exhaustion of the dispensing medium would result with a substantial loss of usable product which would remain indispensable in the container due to loss of dispensing pressure.

Prior dispensers also had other deficiencies such as temperature sensitivity, non-uniform dispensing pressure, limited shelf-like, unreliability, difficulty of manufacture and relatively high cost of manufacture.

The present invention provides a dispensing mechanism which overcomes the above-mentioned deficiencies of the prior art devices are provides additional novel features and advantages, and a wider range of uses, than were possible with devices used heretofore.

BRIEF SUMMARY OF THE INVENTION

Expulsion means for developing and maintaining relatively constant gaseous dispensing pressure in a container from which a product is to be dispensed, comprising an enclosed, fluid impermeable flexible plastic pouch disposed within the container, and having a pair of facing wall members. A plurality of pocket members are disposed within the pouch in spaced relation to one another and affixed to the interior of one of said wall members. A closure member is associated with the interior of the other wall member and releasably closes each of said pocket members. Each pocket member contains a first component, e.g., sodium bicarbonate, of a two-component carbon dioxide gas generation mixture. The second component, e.g., citric acid solution, of said two-component carbon dioxide gas generation mixture is disposed within the pouch and externally of said enclosed pocket members. Starting delay means, e.g., a rupturable or dissolvable capsule containing sodium bicarbonate and/or lithium carbonate is disposed within the pouch in contact with the second component for causing the initial generation of carbon dioxide gas after a prescribed period of time and each pocket member is sequentially severable from the closure member to thereby empty its contents into admixture with the second component to generate more gas as the pouch expands due to the dispensing of the product from the container.

DESCRIPTION OF THE DRAWINGS

FIG. 1 is an elevation sectional view of an aerosol dispensing container including an expulsion means embodiment of the present invention shown in a fragmentary cutaway view;

FIG. 2 is a sectional plan view of the structure shown in FIG. 1 showing the expulsion means in initial collapsed condition;

FIG. 3 is a sectional plan view of the device of FIG. 2 showing the expulsion means in intermediate expanded condition;

FIG. 8 is an enlarged schematic showing heat sealing of the envelope sides to the inner walls of the pouch;

FIGS. 9 through 11 are reduced sectional elevations showing assembly of the envelope containing pouch into an aerosol type dispenser;

FIGS. 12 and 13 are enlarged fragmentary schematic views showing separation of the envelope sides during expansion to open the pocket members; and FIGS. 14 through 17 are schematic representations of different arrangements of the pocket members and different patterns of attachment of the envelope sides to the pouch walls.

DETAILED DESCRIPTION

Figure 4:
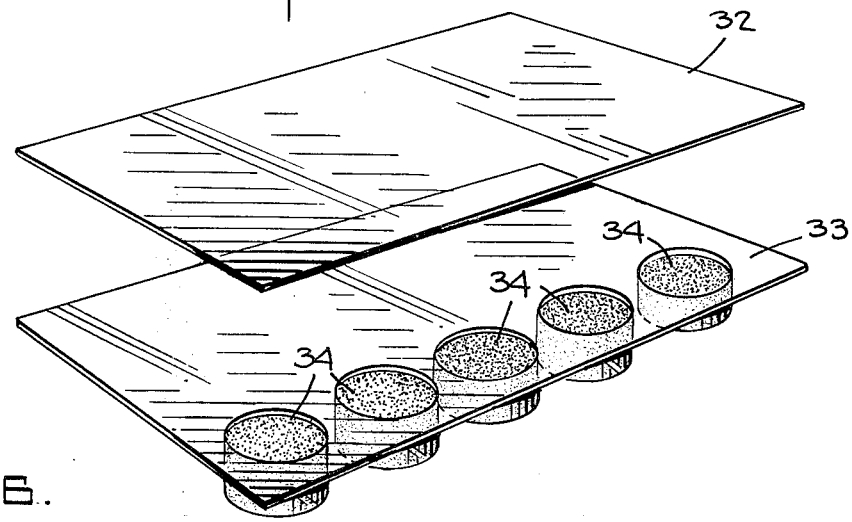
FIG. 4 is an enlarged isometric view of the two envelope sheets of an embodiment of the invention prior to assembly.

Referring now to the drawings, in which each of the various components have the same reference numeral in the different views, and in particular FIGS. 1–3, a fluid tight dispensing container is shown and designated generally by reference numeral 10. Container 10 has a cylindrical body or sidewall 11, inwardly dished bottom 12 and bell-shaped top 13 in which is mounted a conventional spring loaded aerosol spray valve assembly 14. Container 10 and its component parts just described can be fabricated from any suitable material such as thin gauge aluminum or other metal, or even plastic depending on the product to be dispensed and any governing safety specifications that might be involved. Valve assembly 14 is also of conventional design having plunger and spray head 15 carrying spray orifice 16, suitably constructed of plastic, and internal parts (not shown) such as a spring, ball valve and mounting ring 17 and bottom intake member 18 which may be of metal and/or plastic consistent with the previously mentioned requirements.

Within container 10 is liquid product 19 and expulsion assembly 20 which is the subject of the present invention and as will be seen generates and maintains gas pressure within container 10 to enable product 19 to be dispensed on demand.

At the upper end 21 of the interior of cylindrical body 11 is a perforated or foraminous barrier member 22 having a plurality of holes 23 distributed throughout its surface. Also affixed to inner surface 24 of sidewall 11 and extending longitudinally there along is a perforate tube member 25 having a plurality of holes 26 at spaced positions around and along said tube member 25. The function of barrier member 22 and tube member 25 is to insure trouble-free operation of the dispenser and prevent expulsion assembly 20, as it expands in the manner to be described, from blocking off or plugging the interior of the container either laterally/circumferentially or plugging off the valve bottom intake member 18.

Expulsion assembly as shown is disposed within container 10 without being attached or anchored to container 10, although it may, if desired be so connected. Assembly 20 is comprised of generally rectangular envelope, bag or pouch 27 which is constructed of a flexible, fluid impermeable plastic such as, for example, polyethylene or polypropylene and may be fabricated from a sheet of plastic by folding it into overlaid halves *27a, 27b* which are then sealed or adhered by suitable means along their respective contacting side, bottom and top edges 28, 29, 30 respectively to form a sealed enclosure as shown in FIGS. 1–3 inclusive.

Figure 6:
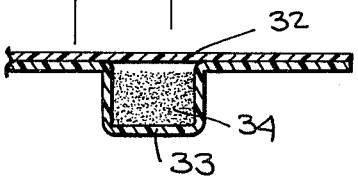
FIG. 6 is a sectional view taken along lines 6—6 of FIG. 5.
Figure 5:
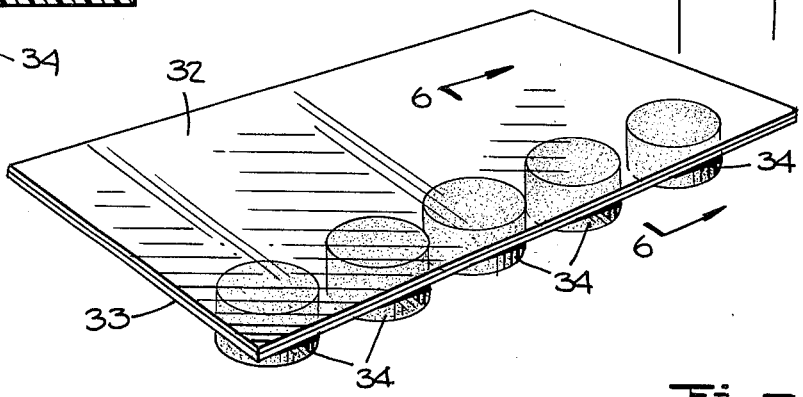
FIG. 5 is an enlarged isometric view of the two envelope sheets of FIG. 4 in assembled condition.

Disposed within pouch 27 is fluid impermeable flexible plastic sandwich or enfoldment 31 having a pair of facing wall members 32, 33 releasably adhered to one another (see also FIGS. 2 through 6) and permanently attached by suitable means such as heat sealed portions 35 to respective interior sides *27c, 27d* of pouch halves *27a, 27b* respectively. One wall member 32 is a substantially flat and the other wall member 33 has a plurality of cup-shaped depressions, cavities or pocket members 34 disposed inwardly from one surface thereof at spaced positions and aligned generally longitudinally of said enfoldment 31 which in turn is similarly aligned with respect to said envelope 20 in a substantially longitudinal relationship as shown in FIG. 1. Pocket members 34 are "lidded" or closed by wall member 32 to encapsulate within each cavity 34 an aliquot of sodium bicarbonate 36 which may be either in the form of powder or a solution. In the interior of pouch 27 is citric acid solution 37. Also disposed in said citric acid solution is starting means 38 which as shown is in the form of a dissolvable capsule and contains an initial charge of sodium bicarbonate which, after a predetermined period of time after assembly of the pouch 27 in container 10, filling the container with product 19 and capping it with the top 13 and associated parts, capsule 38 dissolves and causes the sodium carbonate contained therein to mix with the citric acid solution 37 and generate the initial quantity of carbon dioxide gas, thereby expanding envelope or pouch 27 and providing dispensing pressure within container 10.

The pouch member 27 in one preferred embodiment is constructed of a three layer laminated film having a middle layer of Saran, the external layer of Mylar and the inside layer (interior of the pouch) being low density polyethylene, each of said layers being approximately 2.5 mils in thickness except for the saran layer, which is only deposited from a spray. The characteristics required or desired in said pouch is that it be non-toxic, have sufficient mechanical strength and chemical stability, be heat sealable (to the wall members) and flexible but not appreciably elastic or stretchable.

Wall member 32 is fabricated from material which contacts the bag 27 and is of compatible plastic, e.g., polyethylene. In one preferred embodiment it has an overall thickness of about 4.5 mils and is a three layer sandwich of about 0.5 mil Mylar in the middle and about 2.0 mils low density polyethylene either side.

Wall member 33 carrying the cup-shaped depressions 34 is adapted for deep drawing and is in one preferred embodiment a laminated plastic having an exterior layer (the layer in contact with pouch 27) of low density polyethylene of from about 0.5 to about 20 mils thick and an interior layer (the other side) of polypropylene of from about 0.1 to about 3.75 mils thick or higher. It is to be understood that cavities 34 and capsule 38 may carry the citric acid and solution 37 may be sodium bicarbonate and water, or the two carbon dioxide generating components can be switched the other way around.

A typical formulation is for each depression 34 and the capsule 38 to be charged with about 1 gram each of a 50% citric acid solution and the envelope content 37 to be about 5 to 10 grams of sodium bicarbonate mixed with about 5 grams of water.

The pressure generated within container 10 is of the order of about 120 psig ±20% at an ambient temperature of about 70° F., but any desired pressure may be developed by adjusting the stoichiometry of the particular gas-generating ingredients.

While for most practical applications of the invention sodium bicarbonate and citric acid are normally preferred, it is possible that under particular circumstances other materials may be more suitable such as, for example, dilute hydrochloric acid (e.g., 10–30% even up to about 35%) in place of the citric acid, and lithium carbonate or calcium carbonate in place of the sodium bicarbonate.

Various starting delay means can be employed in addition to dissolvable capsule 38.

Figure 7:
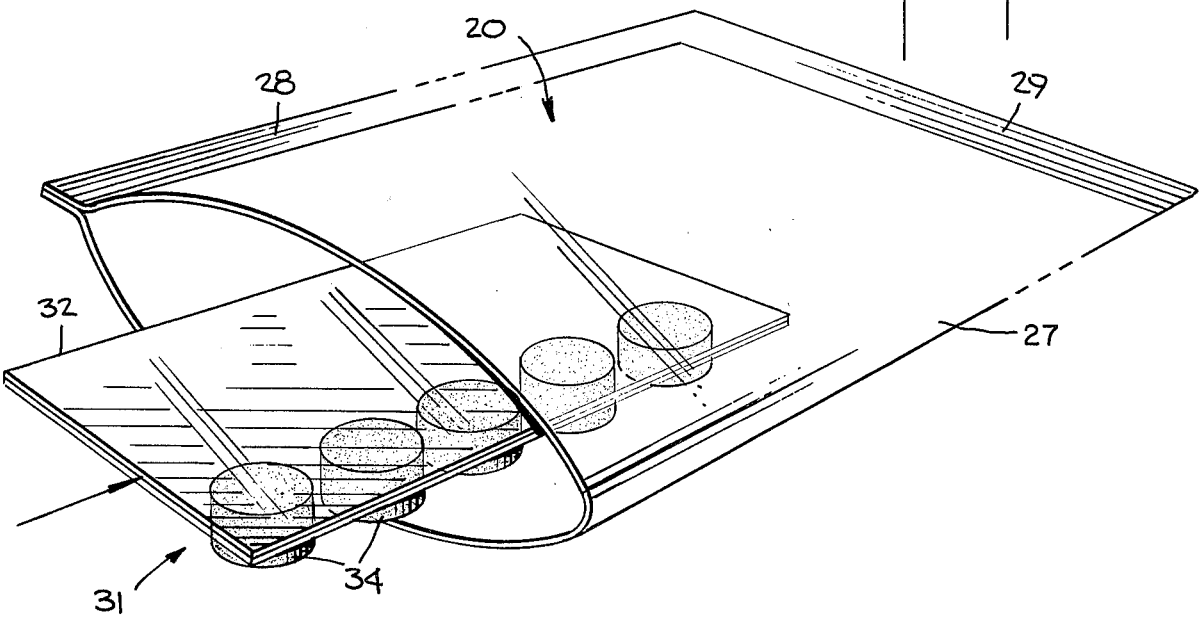
FIG. 7 is an enlarged schematic showing the method of insertion of the envelope into the pouch.

The method of assembly is depicted schematically in FIGS. 4–8 and 9–11. Sheet 33 is formed in a mold by heating and drawing to form cavities 34. The cavities are then filled with one component, e.g., citric acid. Sheet 32 is overlayed on sheet 33 to close cavities 34 and the two wall members are heat sealed together (FIG. 5) and enfoldment 31 is inserted into the open end 39 of pouch or bag 27 (FIG. 7) and the two members 31 and 27 are heat sealed together at 35. Sodium carbonate solution 37 and starting capsule 38 are added to pouch 27 and then upper edge 30 of pouch 27 is heat sealed to completely enclose the contents in pouch 27 (FIG. 8). The expulsion means assembly 20 is then inserted into container 10 and product 19 added, barrier member 22 put into place, and top 13 affixed to container 10 (FIG. 10). After elapse of the prescribed period of time, starting capsule 38 has dissolved, generating carbon dioxide gas, expanding pouch 27 and the dispenser is now ready for use (FIG. 11). FIGS. 3, 12 and 13 show schematically how expansion of pouch 27, to separate inner sides of which wall members 32, 33 are permanently attached, successively pulls apart portions of releasably adhered wall members 32, 33 to successively expose the contents of each cavity 34 and deliver it into contact and admixture with other gas generating component 37 in the bottom of the pouch.

FIGS. 14–17 depict variations in the arrangement of cavities 34 and heat seals 35 as well as in configurations and relative dimensions of pouch 27 and enfoldment 31.

A dispensing apparatus containing the expulsion means of the present invention has the following advantages and features:

1. no flammable propellants are used, thereby eliminating the dangers of prior art assemblies;
2. the assembled containers can be steam sterilized without affecting operating performance;
3. a constant balanced internal dispensing pressure is maintained at the user's demand and insures a continual even flow of product at room temperature, regardless of the amount of product remaining in the container;
4. the product never comes into contact with the propellant, eliminating any danger of contamination of the product, such as taste or smell;
5. the dispenser will discharge its contents in any position, upright, horizontal or inverted and without escape of propellant;

6. the spray does not chill the sprayed surface as is caused by hydrocarbon propellants;
7. there is no pollution or contamination of the atmosphere with the propellant because it remains in the container; and
8. ease and low cost of manufacture, extended shelf life and reliability of service make this dispenser highly advantageous over prior art dispensers.

While certain embodiments of the invention have been shown and described herein, it is to be understood that changes and additions may be made by those skilled in the art without departing from the scope and spirit of the invention.

What is claimed is:

1. In an aerosol type dispenser, internal expulsion means for developing and maintaining relatively constant gaseous dispensing pressure for the product being dispensed, said means comprising an enclosed, fluid impermeable flexible pouch disposed within said dispenser, and having a pair of facing wall members, a plurality of pocket members disposed within said pouch in spaced relation to one another and affixed to the interior of a first of said wall members, closure members associated with the interior of the other said wall member and releasably closing each of said pocket members, a first component of a two-component gas generation mixture disposed within each pocket member, the second component of said two-component gas generation mixture disposed within said pouch and externally of said enclosed pocket members, starting delay means disposed within said pouch in contact with said second component for causing the initial generation of gas after a prescribed period of time, said pocket members being sequentially severable from said closure members to empty their contents into admixture with said second component to generate more gas as said pouch expands due to the dispensing of said product.

2. In an aerosol type dispenser, internal expulsion means for developing and maintaining relatively constant gaseous dispensing pressure for the product being dispensed, said means comprising an enclosed, fluid impermeable flexible pouch disposed within said dispenser, and having a pair of facing wall members, a plurality of interconnected pocket members disposed within said pouch in spaced relation to one another and affixed to the interior of a first of said wall members, a common closure member associated with the interior of the other said wall member and releasably closing each of said pocket members, a first component of a two-component gas generation mixture disposed within each pocket member, the second component of said two-component component gas generation mixture disposed within said pouch and externally of said enclosed pocket members, starting delay means disposed within said pouch in contact with said second component for causing the initial generation of gas after a prescribed period of time, each said pocket member being sequentially severable from said closure member to empty their contents into admixture with said second component to generate more gas as said pouch expands due to the dispensing of said product.

3. In an aerosol type dispenser, internal expulsion means for developing and maintaining relatively constant gaseous dispensing pressure for the product being dispensed, said means comprising an enclosed, fluid impermeable flexible pouch disposed within said dispenser, and having a pair of facing wall members, a plurality of interconnected pocket members disposed within said pouch in spaced relation to one another and affixed to the interior of a first of said wall members, a common closure member associated with the interior of the other said wall members and releasably closing each of said pocket members, a first component of a two-component gas generation mixture disposed within each pocket member, the second component of said two-component gas generation mixture disposed within said pouch and externally of said enclosed pocket members, starting delay means carrying a portion of said first component and disposed within said pouch in contact with said second component for causing the initial generation of gas after a prescribed period of time, said pocket members being sequentially severable from said closure member to empty their contents into admixture with said second component to generate more gas as said pouch expands due to the dispensing of said product.

4. In the apparatus of claim 3, said pouch comprised of plastic, being generally elongated and completely enclosed, and said pocket members being disposed at spaced positions generally longitudinally of said pouch.

5. In the apparatus of claim 4, said pocket members being formed in a first plastic sheet adhered to said first wall member and said common closure member comprised of a second plastic sheet adhered to said other wall member.

6. In the apparatus of claim 5, each said pocket member containing citric acid solution as said first component and said pouch containing sodium bicarbonate powder and water as said second component, and said gas being carbon dioxide.

7. In a self-pressuring dispensing apparatus of the type having an outer container, a manually actuatable atomizing and dispensing valve on said container, a dispensible medium within said container and means within said container for providing dispensing pressure for said medium, the improvement comprising a liquid impermeable expansible envelope disposed within said container, said dispensible medium disposed externally of said envelope, a first component of a two-component gas generating composition disposed within said envelope, and a pair of sheets permanently attached on their outer surfaces to the inner facing surfaces of said envelope and releasably adhered to one another, at least one of said sheets having a plurality of depressions in its surface each carrying an aliquot of the second component of said composition, the other sheet closing and encapsulating the second component in said depressions and being adapted, upon outward expansion of said envelope due to the pressure of carbon dioxide generated therein and the dispensing of said medium through said valve, to gradually separate from said first sheet and to sequentially open the enclosed depressions thereby permitting said aliquots of said second component to contact said first component and generate additional carbon dioxide within said envelope.

8. In a self-pressuring dispensing apparatus of the type having an outer container, a manually actuatable atomizing and dispensing valve on said container, a dispensible medium within said container and means within said container for providing dispensing pressure for said medium, the improvement comprising a liquid impermeable expansible envelope disposed within said container, said dispensible medium disposed externally of said envelope, a first component of a two-component gas generating composition disposed within said envelope, and a pair of sheets permanently attached on their outer surfaces to the inner facing surfaces of said envelope and releasably adhered to one another over substantially their entire contacting surfaces, at least one of said sheets having a plurality of depressions in its surface each carrying an aliquot of the second component of said composition, the other sheet closing and encapsulating the second component in said depressions and being adapted, upon outward expansion of said envelope due to the pressure of carbon dioxide gas generated therein and the dispensing of said medium through said valve, to gradually separate from said first sheet and to sequentially open the enclosed depressions thereby permitting said aliquots of said second component to contact said first component and generate additional carbon dioxide within said envelope.

9. In the apparatus of claim 7, said first component comprised of a compound selected from the class consisting of barium carbonate, calcium carbonate and sodium bicarbonate and said second component being a water soluble acid.

10. In the apparatus of claim 7, said first component comprised of sodium bicarbonate and said second component being a water soluble carboxylic acid.

11. In the apparatus of claim 7, said first component comprised of sodium bicarbonate and said second component being citric acid.

12. In the apparatus of claim 11, said envelope comprised of a three layer laminated plastic, the external layer being mylar polyester 0.5 to 3.00 mils in thickness, the inner layer being low density polyethylene 0.5 to 20 mils in thickness, and the middle layer being saran deposited by spraying at least one of the inner surfaces of said mylar and polyethylene layers.

13. In the apparatus of claim 12, the sheet of said pair carrying said depressions comprised of a two-layer plastic lamination having an outer layer of low density polyethylene about 0.5 to 10.00 mils thick attached to said envelope and an inner layer of polypropylene 0.1 to 8 mils thick.

14. In the apparatus of claim 13, the other said sheet of said pair comprised of a three layer plastic sandwich lamination having an inner Mylar layer of 0.3 to 3.00 mils thickness, the outer layers of the sandwich having low density polyethylene of 0.3 to 20 mils thick each.

15. In a self-pressuring dispensing apparatus of the type having an outer container, a manually actuatable atomizing and dispensing valve on said container, a dispensible medium within said container and means within said container for providing dispensing pressure for said medium, the improvement comprising a liquid impermeable expansible envelope disposed within said container, said dispensible medium disposed externally of said envelope, a first component of a two-component gas generating composition disposed within said envelope, and an enfoldment of two sheets permanently adhered on their outer surfaces to the inner facing surfaces of said envelope and releasably adhered to one another, at least one of said sheets having a plurality of depressions in its surface each carrying an aliquot of the second component of said composition, the other sheet enclosing and encapsulating the second component in said depressions and being adapted, upon outward expansion of said envelope due to the pressure of carbon dioxide generated therein and the dispensing of said medium through said valve, to gradually separate from said first sheet and to sequentially open the enclosed depressions thereby permitting said aliquots of said second component to contact said first component and generate additional carbon dioxide within said envelope.

16. In a self-pressuring dispensing apparatus of the type having an outer container, a manually actuatable atomizing and dispensing valve on said container, a liquid medium within said container to be dispensed, and means within said container for providing dispensing pressure for said medium, the improvement comprising a liquid impermeable expansible envelope disposed within said container, said liquid medium disposed externally of said envelope, a first component of a two-component carbon dioxide generating composition disposed within said envelope, and a pair of two generally congruent sheets permanently adhered on their outer surfaces to the inner facing surfaces of said envelope and releasably adhered along at least portions of their respective margins to one another, at least one of said sheets having a plurality of cup-shaped depressions in its surface at longitudinally spaced positions each carrying an aliquot of the second component of said composition, the other sheet enclosing and encapsulating the second component in said depressions and being adapted, upon outward expansion of of said envelope due to the pressure of carbon dioxide generated therein and the dispensing of said medium through said valve, to gradually separate from said first sheet and to sequentially open the enclosed cups thereby permitting said aliquots of said second component to contact said first component and generate additional carbon dioxide within said envelope.

17. In a self-pressuring dispensing apparatus of the type having an outer container, a manually actuatable atomizing and dispensing valve on said container, a liquid medium within said container to be dispensed, and means within said container for providing dispensing pressure for said medium, the improvement comprising a liquid impermeable expansible envelope disposed within said container, said liquid medium disposed externally of said envelope, a first component of a two-component carbon dioxide generating composition disposed within said envelope, and an enfoldment of two generally congruent sheets permanently adhered on their outer surfaces to the inner facing surfaces of said envelope and releasably adhered along at least portions of their respective margins to one another, at least one of said sheets having a plurality of cup-shaped depressions in its surface at longitudinally spaced positions each carrying an aliquot of the second component of said composition, the other sheet enclosing and encapsulating the second component in said depressions and being adapted, upon outward expansion of said envelope due to the pressure of carbon dioxide generated therein and the dispensing of said medium through said valve, to gradually separate from said first sheet and to sequentially open the enclosed cups thereby permitting said aliquots of said second component to contact said first component and generate additional carbon dioxide within said envelope.

18. In the apparatus of claim 16, said first component being sodium bicarbonate solution, said second component being citric acid solution, and said apparatus including delaying means within said envelope encapsulating citric acid for introducing said sodium bicarbonate into said citric acid solution to initiate the generation of carbon dioxide gas within said envelope after a predetermined time delay.

19. Expulsion means for developing and maintaining relatively constant gaseous dispensing pressure in a container for a product being disposed from said container, said means comprising an enclosed, fluid impermeable flexible pouch adapted to be disposed within said container and having a pair of facing wall members, a plurality of pocket members disposed within said pouch in spaced relation to one another and each affixed to the interior of a respective one of said wall members, a closure member for each pocket member associated with the interior of the other said wall member and releasably enclosing said pocket member, a first component of a two-component gas generation mixture disposed within each pocket member, the second component of said two-component gas generation mixture disposed within said pouch and externally of said enclosed pocket members, starting delay means carrying a portion of said first component and disposed within said pouch in contact with said second component for causing the initial generation of gas after a prescribed period of time, said pocket members being sequentially severable from their closure members to empty their contents into admixture with said second component to generate more gas as said pouch expands.

20. Expulsion means for developing and maintaining relatively constant gaseous dispensing pressure in a container for a product being dispensed from the container, said means comprising an enclosed, fluid impermeable flexible pouch adapted to be disposed within said container and having a pair of facing wall members, a plurality of pocket members disposed within said pouch in spaced relation to one another and affixed to the interior of a first of said wall members, a common closure member associated with the interior of the other side wall member and releasably enclosing each of said pocket members, a first component of a two-component gas generation mixture disposed within each pocket member, the second component of said two-component gas generation mixture disposed within said pouch and externally of said enclosed pocket members, starting delay means carrying a portion of said first component and disposed within said pouch in contact with said second component for causing the initial generation of gas after a prescribed period of time, said pocket members being sequentially severable from said closure member to empty their contents into admixture with said second component to generate more gas as said pouch expands.

21. Expulsion means for developing and maintaining relatively constant gaseous dispensing pressure in an aerosol type dispenser for the product being dispensed, said means comprising an enclosed, elongated fluid impermeable flexible pouch adapted to be disposed within said dispenser, and having a pair of facing wall members, a plurality of pocket members disposed within said pouch in spaced relation to one another and generally longitudinally of said pouch and affixed to the interior of a first of said wall members, a common closure member associated with the interior of the other said wall member and releasably enclosing each of said pocket members, a first component of a two-component gas generation mixture disposed within each pocket member, the second component of said two-component gas generation mixture disposed within said pouch and externally of said enclosed pocket members, starting delay means carrying a third component and disposed within said pouch in contact with said second component for causing the initial generation of gas after a prescribed period of time, said pocket members being sequentially severable from said closure member to empty their contents into admixture with said second component to generate more gas as said pouch expands.

22. In the apparatus of claim 19, said pouch comprised of laminated plastic film having an interior layer of low density polyethylene, said pocket members comprised of laminated plastic film having an exterior layer of low density polyethylene from about 0.5 to about 20 mils thick and an interior layer of polypropylene from about 0.1 to about 10.00 mils thick, and said polyethylene layers of said pouch and said pocket members being permanently heat sealed together.

23. In the apparatus of claim 22, each said closure member having at least one surface comprised of low density polyethylene of from about 0.1 to 20 mils thick and being permanently adhered to the interior of its associated wall member at that surface.

24. In the apparatus of claim 23, each said pocket member and its closure member being releasably heat sealed together.

25. In the apparatus of claim 5 a plurality of relatively short heat sealed portions, each adjacent and laterally spaced from a respective one of said pocket members, said heat sealed portions permanently joining said first wall member and said first sheet and said second wall member and said second sheet, and releasably joining said second sheet relative to said first sheet, said heat sealed portions being staggered diagonally longitudinally relative to said pocket members to accommodate sequential expansion of said pouch during use.

* * * * *